US006088861A

United States Patent [19]

Sessions et al.

[11] Patent Number: 6,088,861

[45] Date of Patent: Jul. 18, 2000

[54] TOOL WITH LOCKING FOLD-OUT IMPLEMENTS

[75] Inventors: George Christensen Sessions, Milwaukie, Oreg.; Dave Roger Nelson, Brush Prairie, Wash.; Steven J. Hull, San Diego; Thomas A. Gaboury, El Cajon, both of Calif.; Gad J. Shaanan, Westmount, Canada

[73] Assignee: Buck Knives, Inc., El Cajon, Calif.

[21] Appl. No.: 09/239,904

[22] Filed: Jan. 29, 1999

[51] Int. Cl.[7] ..... B25B 7/22

[52] U.S. Cl. ..... 7/128; 7/118; 30/161; 81/440

[58] Field of Search ..... 7/118, 125, 127, 7/128, 129, 158; 30/143, 146, 152, 153, 160, 161; 81/177.4, 177.6, 440, 490

[56] References Cited

U.S. PATENT DOCUMENTS

| | | | |
|---|---|---|---|
| 1,036,664 | 8/1912 | Marble | 81/440 |
| 2,798,290 | 7/1957 | Bassett | 7/118 |
| 2,824,368 | 2/1958 | Bassett | 7/118 |
| 4,124,939 | 11/1978 | Onoue | 30/161 |
| 5,765,247 | 6/1998 | Seber et al. | 7/128 |
| 5,769,094 | 6/1998 | Jenkins, Jr. et al. | 30/161 |
| 5,950,265 | 9/1999 | Allen et al. | 7/118 |

*Primary Examiner*—Stephen F. Gerrity
*Assistant Examiner*—David B. Thomas
*Attorney, Agent, or Firm*—Gregory Garmong

[57] ABSTRACT

A tool includes a body with implements rotatably deployed from the body. The implements have notches in their bases corresponding to open and closed positions, which are engagable by a locking plate of the body. A locking lever rotatably mounted on the body includes a lock actuator plate which does not engage the locking plate when the locking lever is rotated to an unlocked position but does engage the locking plate when the locking lever is rotated to a locked position. The engagement of the locking plate causes it to contact the notches of the implement base, thereby locking the implement either open or closed. The body may be inserted into a handle, such as the handle of a combination tool, so that the operation of the locking lever also locks the body into the handle.

13 Claims, 4 Drawing Sheets

20
22
24
26
28
30
32
34
38
40a
40b
52
54
56
58
60
74
76

20
22
26
28
34
36
38
40
52
54
58
60
74
76

FIG. 3
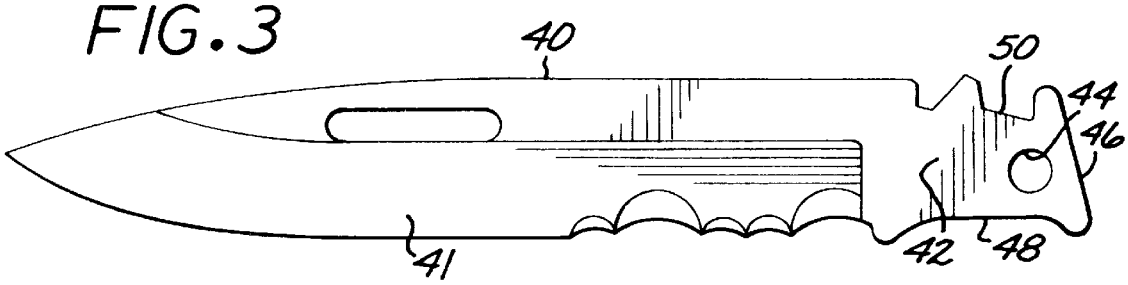
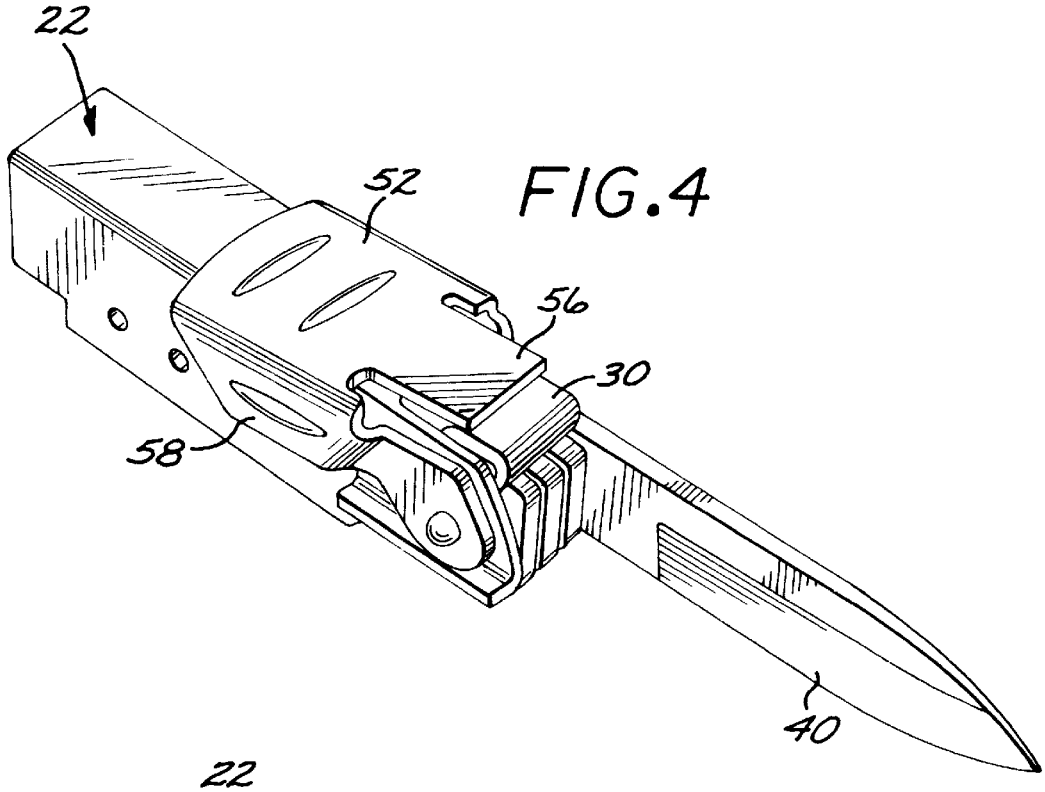
FIG. 4
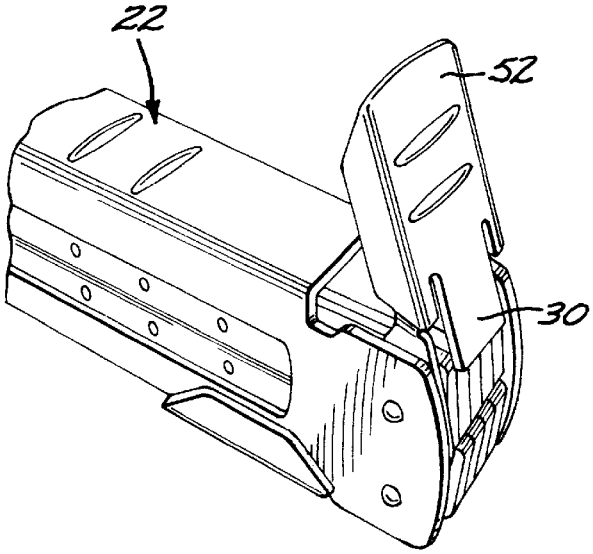
FIG. 5

TOOL WITH LOCKING FOLD-OUT IMPLEMENTS

BACKGROUND OF THE INVENTION

This invention relates to tools, and, more particularly, to a tool in which implements that fold out of a body are locked in the open and closed positions.

Implements with multiple deployable tools have long been known and used in the home, in the workplace, and in sporting applications. A folding pocket knife having two or more blades is an example. The blades are carried inside a handle for storage, and are selectively deployed, one at a time, when required to perform specific functions.

In recent years, devices known generically as "combination tools" or "multifunction tools" have been developed and widely marketed. A combination tool typically is built around a primary tool having a jaw mechanism such as a full-size pliers head or scissors. The jaw mechanism has handles attached thereto. In some cases, the handles are foldable.

A number of implements are received in a folding manner within the handles themselves. Such implements may include, for example, knife blades of different types, screwdriver blades of different types, awls, bottle openers, and the like. When the handle is in the deployed position, the implements folded into the handles are accessible and may be individually folded closed for storage or open for use.

Early combination tools provided detents which biased the implements toward the closed and open positions, so that the implements would be retained in those positions when manually closed or opened, or frictional arrangements that applied a frictional drag to the implements. Such forces may be overcome by a high, but commonly experienced, applied force. This is a particular problem for an implement folded to the open position and used, which may be unintentionally closed, so that the user's hand is injured, when a large working force is applied. It is therefore desirable to selectively lock the implements into the closed and open positions, to minimize the chance of injury to the user. Such a locking mechanism should be free of mechanical instability. The present invention fulfills this need for locking implements, and further provides related advantages.

SUMMARY OF THE INVENTION

This invention provides a tool utilizing a body with fold out implements, wherein the implements are selectively lockable in the closed and open positions. The body and its implements may be used and locked separately. The body may be the handle of a combination tool. The body may instead be a separate structure that is inserted into a handle such as the handle of a combination tool, and locked therein. In the latter embodiment, the implements may be used and selectively locked when the body is separated from the combination tool, or when it is inserted into the handle of the combination tool, using the same locking structure. The locking mechanism of the invention is secure and stable, without significant looseness and wobble in the locked implement.

In accordance with the invention, a tool comprises an elongated body having a U-shaped housing with a body top and two opposing body sides. A locking plate extends from the body top. Two opposing body sides are affixed to the body top. An axle extends between and through the two opposing body sides. There is at least one implement (more usually at least 4 implements) having a base, with each implement being disposed between the two body sides and rotatably supported on the axle. Each base has a lock-close notch therein in facing relation to the locking plate when the implement is rotated on the axle to lie between the two sides and lie along the body axis, and a lock-open notch therein in facing relation to the locking plate when the implement is rotated on the axle to extend outwardly from the body and lie along the body axis. A U-shaped locking lever includes a locking lever top and two locking lever sides spaced sufficiently far apart that they lie outwardly of the two body sides. The locking lever is engaged to and rotatable on the axle. A lock actuator plate extends from the locking lever top, with the lock actuator plate being in facing relationship to the locking plate. The locking lever is rotatable between an unlocked position wherein the lock actuator plate does not engage the locking plate, and a locked position wherein the lock actuator plate engages the locking plate to force it into contact with the base of each implement. When the implements are in their open or closed positions, they are locked by the rotation of the locking lever to the locked position.

The body may itself serve as a handle, such as when the body is the handle of a combination tool. That is, the fold-out implements provided in the handle of a combination tool may be locked closed or open using the approach of the invention.

The body may instead be received into a handle adapted for its use, such as the handle of a compatibly designed combination tool. In this latter case, the handle comprises a handle top, and two opposing handle sides affixed to the handle top. The handle sides are dimensioned such that the body is received therebetween with the locking lever sides lying outwardly of the two handle sides. Operation of the single locking lever serves to lock the body into the handle, as well as to lock the implements into the closed or open positions. The implements in the body may therefore be used and selectively locked open or closed, whether the body is inserted into the handle or removed from the handle and used separately from the handle. A user may carry several different bodies according to specialized needs, and use them either inserted into or separate from the handle of the combination tool, if any, without sacrificing the locking capability.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

BRIEF DESCRIPTION OF THE DRAWINGS

FIG. 3 is a side elevational view of an implement;

FIG. 4 is a perspective view of the body used separately from the handle;

FIG. 5 is a detail perspective view of the body with the locking lever in the unlocked position;

DETAILED DESCRIPTION OF THE INVENTION

Figure 6:
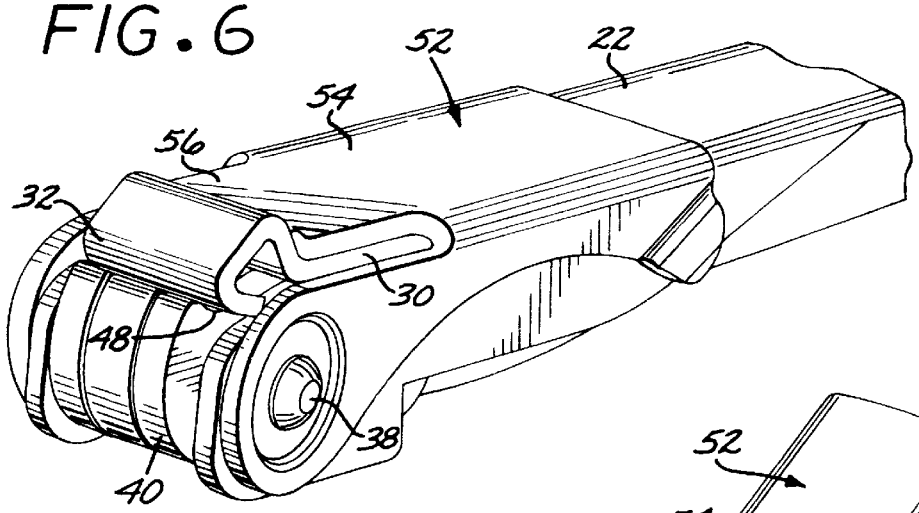
FIG. 6 is a detail perspective view of the body illustrating the relation of the inward curl of the locking plate and the lock-close notches, and the locking lever in the locked position.
Figure 7:
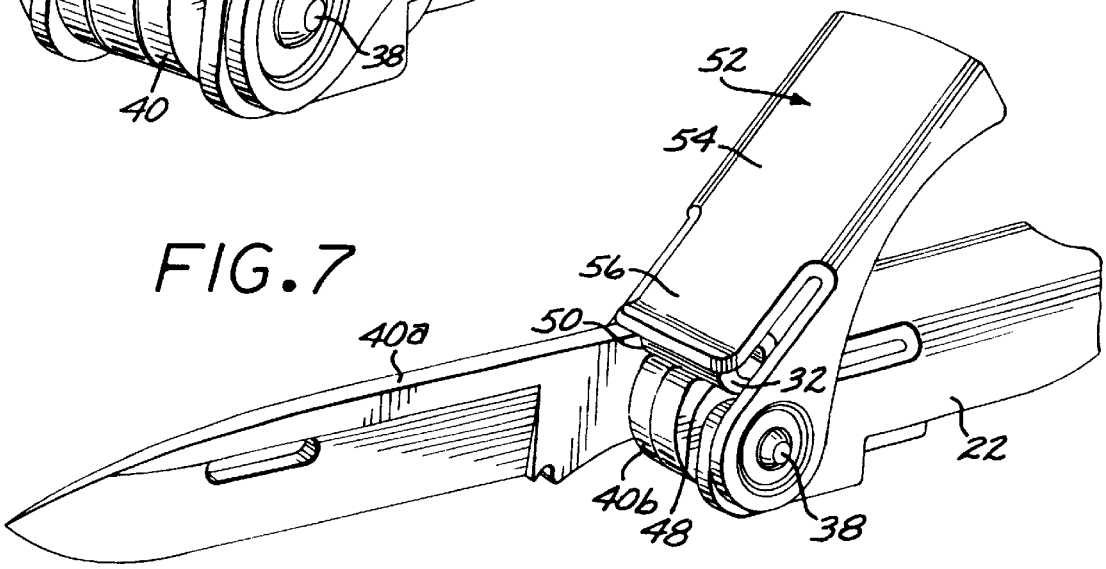
FIG. 7 is a detail perspective view of the body with the locking lever in the unlocked position.

Two preferred embodiments of the application of the tool of the invention are disclosed. In one, illustrated in FIGS. 1, 2, 4, 5 and 8, the tool includes a body that is slidably received into the handle of a combination tool. In the other application, illustrated in FIG. 9, the body is itself the integral handle of a combination tool in which implements are foldably received. The locking mechanism discussed in relation to the embodiment of FIGS. 1, 2, 4, 5, and 8 as well as in relation to FIGS. 3, 6, and 7, is applicable both to the embodiment of FIGS. 1, 2, 4, 5, and 8, and to that of FIG. 9. The discussion of the locking mechanism is presented in full detail in relation to the embodiment of FIGS. 1, 2, 4, 5, and 8, and that discussion is incorporated by reference into the discussion of the embodiment of FIG. 9.

Figures 1, 2:
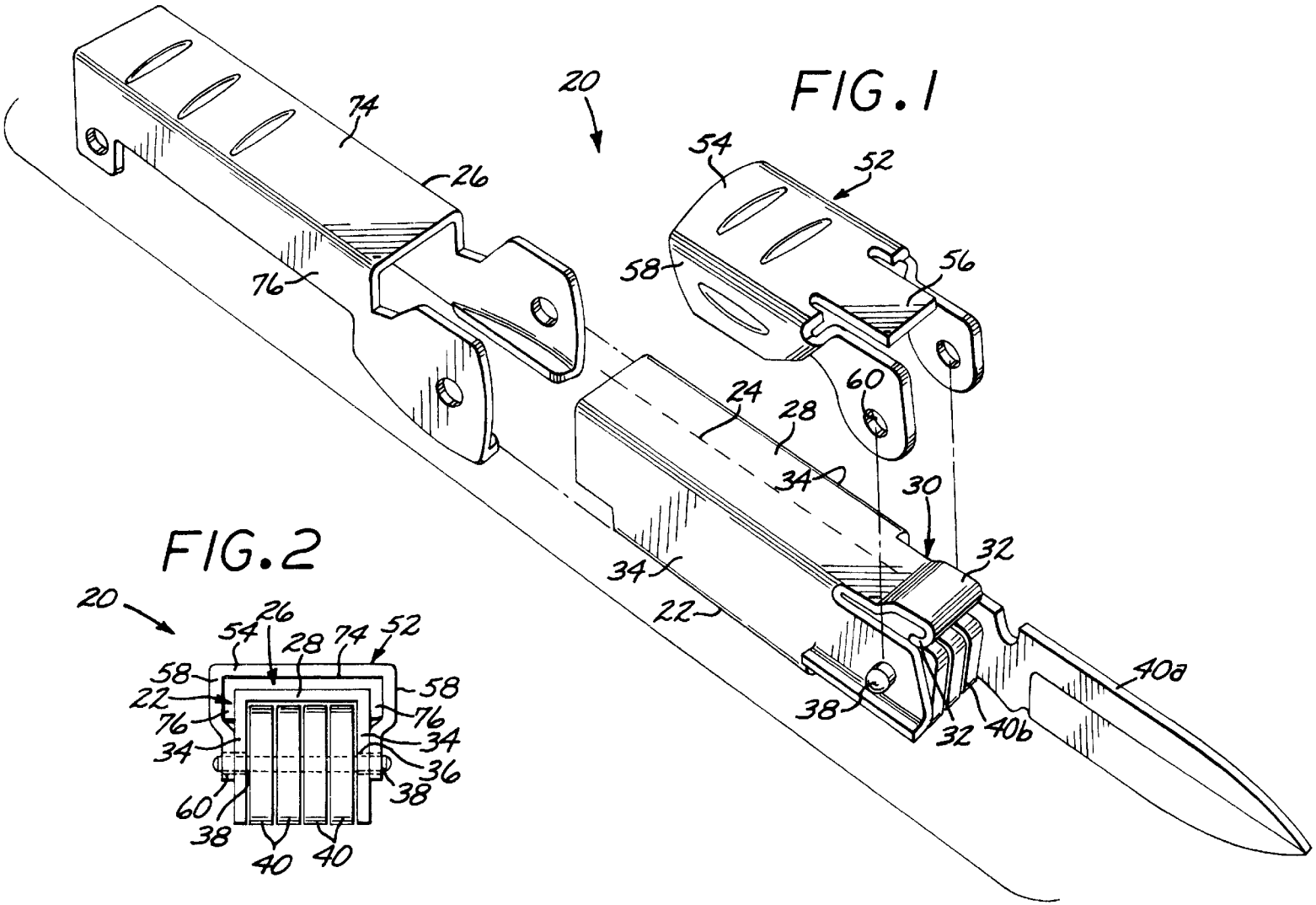
FIG. 1 is a perspective, partially exploded view of a first embodiment of a tool in accordance with the invention.
FIG. 2 is a cross sectional view of the body when inserted into the handle.

FIG. 1 illustrates a tool 20 including a body 22 elongated along a body axis of elongation 24. In this first embodiment, the body 22 is received into a handle 26 by sliding the body 22 in a direction parallel to the body axis of elongation 24. FIG. 1 depicts the body 22 slidably removed from the handle 26, and FIG. 2 is a cross sectional view, perpendicular to the body axis of elongation 24, of the body 22 inserted into the handle 26 (with some portions of the handle 26 omitted for clarity).

The body 22 comprises a body top 28 having a locking plate 30 extending therefrom so that the locking plate functions as a leaf spring. The locking plate 30 is preferably integral with the body top 28. The locking plate 30 desirably has an inward curl 32 at a distal end thereof to form a shape similar to a candy cane or a shepard's crooked staff. The inward curl 32 may be produced by first having the locking plate 30 bent upwardly and then downwardly and under upon itself, as illustrated. All or part of the locking plate 30 also may be produced as a separate element and then attached to the body top 28 by any appropriate technique, such as a rivet, welding, or the like.

The body 22 also comprises two opposing body sides 34. The body sides 34 are affixed to the body top 28, and preferably are integrally formed with the body top 28 from a single sheet of metal. The locking plate 30 is not connected directly to the body sides 34, but instead is connected only to the body top 28 in the manner of a leaf spring. Taken together, the body top 28 and the body sides 34 form a squared U-shape as seen in FIG. 2, with the fourth side of the body 22 open.

A pair of aligned axle bores 36 extend through the body sides 34 at one end of the body 22. An axle 38 extends through the axle bores 36 and thence through the body sides 32.

At least one implement 40 is provided in the body 22. The implements 40 are thin, blade-type implements, such as general purpose knife blades, wrenches, screwdrivers, scissors, awls, bottle openers, and the like. The blades may also be special-purpose tools, such as spoke wrenches for bicyclists, fly-tying aids for fishermen, and horse picks for equestrians.

FIG. 3 shows the entirety of a representative one of the implements 40. Each implement 40 has a working portion 41, and a base 42 with a base bore 44 therethrough. The base 42 has a perimeter 46 which has a lock-close notch 48 is formed on a bottom side of the base 42, and a oppositely disposed lock-open notch 50 is formed on a top side of the base 42. The notches 48 and 50 are sized to receive the inward curl 32 of the locking plate 30 therein, for achieving locking of the implement 40 in the closed and open positions, respectively, as will be described subsequently.

Each of the bases 42 of the respective implements 40 is positioned between the body sides 34, so that the base bores 44 are aligned with the axle bores 36 of the body sides 34. The axle 38 extends through the base bores 44 and the axle bores 36. Each of the implements 40 is rotatable on the axle 38 between two extreme positions: an open position where the working portion of the implement 40 does not lie between the body sides 34, but instead extends out of the body 22 parallel to the axis 24; and a closed position where the working portion of the implement 40 lies between the body sides 34 and lies parallel to the axis 24. In FIG. 1, an implement 40*a* is in the open position, and other implements 40*b* are in the closed position. When the implement 40 is rotated to the closed position, the lock-close notch 48 is in facing relation to the inward curl 32 of the locking plate 30. When the implement 40 is rotated to the open position, the lock-open notch 50 is in facing relation to the inward curl 32 of the locking plate 30.

The tool 20 further includes a locking lever 52 having a locking lever top 54 with a lock actuator plate 56 extending therefrom. The locking lever plate 56 is in a generally facing relationship with the locking plate 30 over at least a portion of their lengths, as seen in FIG. 4.

Two opposed locking lever sides 58 are affixed to the locking lever top 54, forming a generally squared U-shape with the locking lever top 54. Preferably, the locking lever sides 58 are integral with the locking lever top 54, and made from a single piece of formed metal sheet. The fourth side is open. The two locking lever sides 58 are spaced sufficiently far apart that they lie outwardly of the two respective body sides 34. That is, the locking lever top 54 may overlie the body 22 and the body top 28 in facing contact when the locking lever 52 is in the locked position. In the slide-in application of FIG. 1, where the handle 26 is also provided, the locking lever sides 58 must be spaced sufficiently far apart that they lie outwardly of the two respective handle sides, as well.

A pair of aligned engagement bores 60 extend through the two locking lever sides 58. The engagement bores 60 are received on and engaged to the outer ends of the axle 38. To accomplish this engagement, the locking lever sides 58 having the engagement bores 60 may be positioned inwardly (as by bending the sheet metal) from the portion of the side that is contiguous with the locking lever top 54, as illustrated. The locking lever 52 is thereby engaged to and rotatable on the axle 38.

The locking lever 52 is rotatable between an unlocked position where it is raised from the body top 28, as shown in FIG. 5, and a locked position where it lies in facing relationship to the body top 28, as shown in FIGS. 1, 2, and 4.

FIGS. 6 and 7 illustrate the operation of the locking mechanism in more detail. Referring to FIG. 6, in which the locking lever 52 is in the closed position, the inward curl 32 of the locking plate 30 is positioned in facing relation to the lock-close notch 48 when the implement 40 is in the illustrated closed position. The locking plate 30 is dimensioned so that, when pressed downwardly toward the base 42 of the implement 40, the inward curl 32 of the locking plate 30 engages the lock-close notch 48, thereby locking the implement 40 in the closed position. The inward curl 32 thereby serves as a locking bar which is controllably engaged to the implements 40, and most preferably to the notches in the implements 40. Similarly but not illustrated, the locking plate engages the lock-open notch 50 when the implement is rotated to the open position.

When the locking lever 52 is raised to its open position as shown in FIG. 7, the locking plate 30 unbends to a straight configuration so that the inward curl 32 does not engage the notches 48 and 50, as shown in FIG. 7. (The inward curl 32 may rest against or contact the implements in this position, but it does not engage them to achieve locking.) To lock the implements 40 in either the closed or open position, the locking lever 52 is rotated, clockwise in the view of FIG. 7, so that the lock actuator plate 56 engages and forces the inward curl 32 of the locking plate 30 downwardly, to engage the notch 48 or 50. Desirably, the force reaction vector between the lock actuator plate 56 and the locking plate 30, when the locking lever 52 is forced downwardly into facing contact with the body top 28, lies rearwardly of the axle 38.

As shown in FIG. 7, one of the implements 40*a* may be locked into its open position by the engagement of the inward curl to its lock-open notch 50, and the others of the implements 40*b* may be locked into their closed positions by the simultaneous engagement of the inward curl 32 to their respective lock-close notches 48. The open implement 40*a* in use cannot inadvertently close, as on the fingers of the user, and the closed implements 40*b* cannot inadvertently open to interfere with the work or to cause injury to the user. The stability and freedom from wobble achieved with the locking structure of the invention is important in achieving this safety in operation.

Thus, a single locking lever 52 is operable to simultaneously lock one or more implements closed, and one or more implements open. The shape of the inward curl 32 and the sloping surfaces of the notches 48 and 50 are cooperatively selected so that the implement is biased toward the respective closed or open position, in those cases where the inward curl 32 is contacted to the notch 48 and 50 when the implement is close to its closed or open position.

Figure 8:
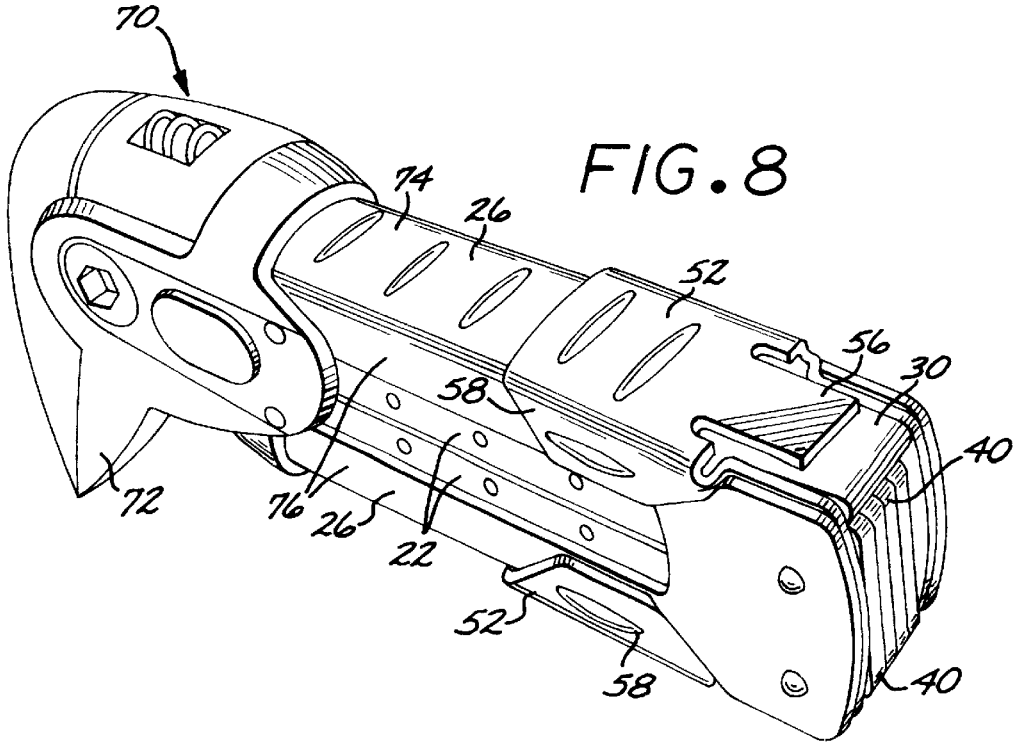
FIG. 8 is an elevational view of a combination tool utilizing the first embodiment of the approach of the invention.

One application of the present invention provides a combination tool 70 illustrated in FIG. 8. The combination tool 70 has two handles 26 extending from a jaw 72. One body 22 is inserted, by sliding, into each of the two handles 26. Separate locking levers 52 are provided for each of the two handles 26 and two bodies 22.

Each handle 26 includes a handle top 74 and two opposing handle sides 76 affixed to the handle top 74, forming a squared U-shape. The fourth side of the handle 26 is open. The handle sides 76 are dimensioned such that the body 22 is received therebetween with the locking lever sides 58 lying outwardly of the two handle sides 76, as shown in FIG. 2. The prior description of the locking mechanism is incorporated here.

Figure 9:
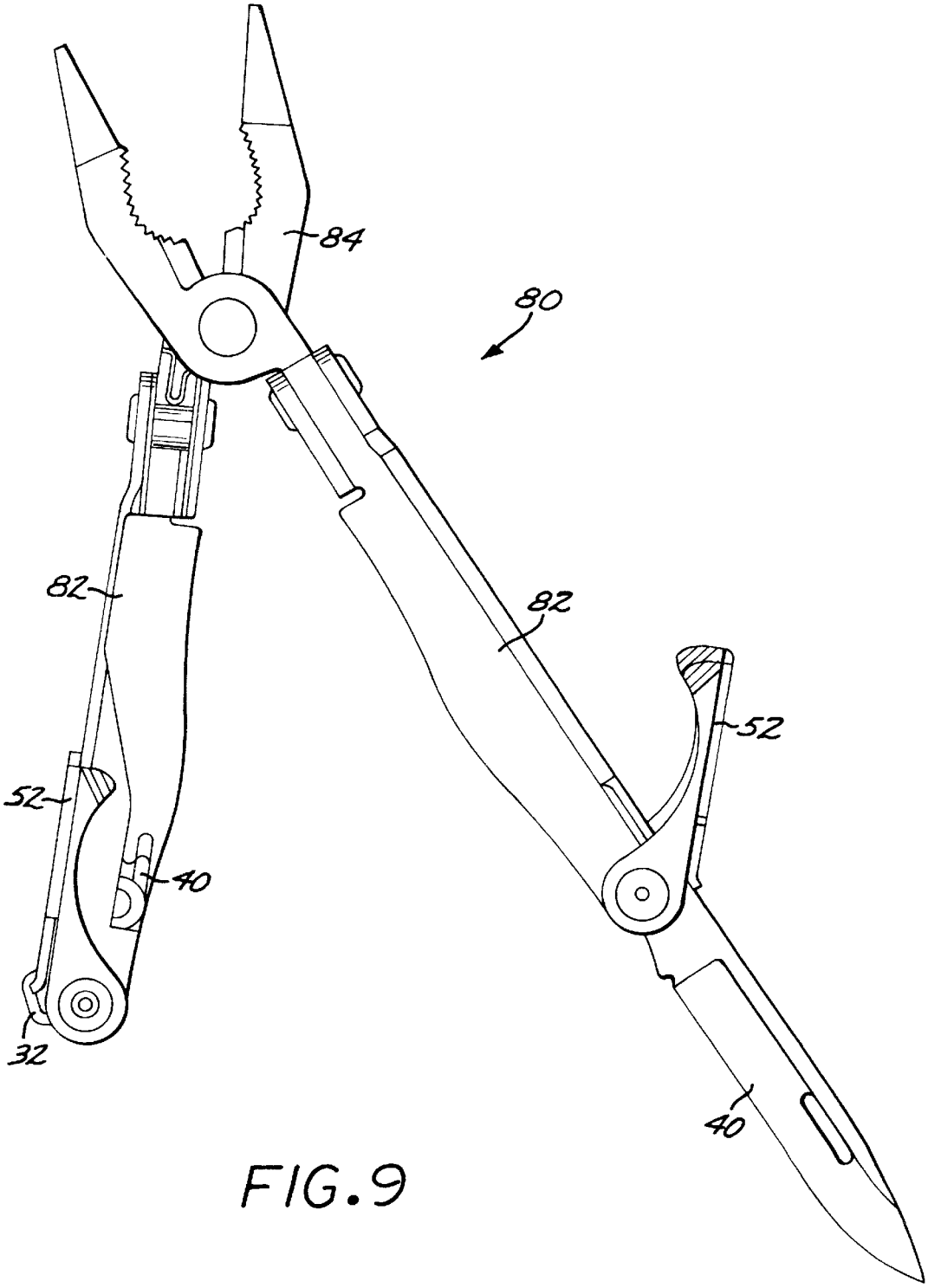
FIG. 9 is an elevational view of a combination tool utilizing a second embodiment of the approach of the invention.

A second application of the present invention provides a combination tool 80 illustrated in FIG. 9. In this case, the combination tool 80 also has two handles 82 extending from a jaw 84. The handles 82 form the bodies of the respective tools. The body is thus integral with the handle, and does not slide into the handle as in the embodiment of FIG. 8. The prior description of the locking mechanism is incorporated here.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A tool, comprising:

an elongated body having a body axis of elongation, the body comprising a body top having a locking plate extending therefrom, the locking plate including an inward curl at a distal end thereof, two opposing body sides affixed to the body top, the cassette being open on a fourth side, and a pair of aligned axle bores extending through the two body sides at one end of the body;

an axle extending through the pair of axle bores;

at least one implement having a base and a base bore therethrough, each implement being disposed between the two body sides with the axle extending through the base bore, each base having a lock-close notch therein in facing relation to the inward curl of the locking plate when the implement is rotated on the axle to lie between the two sides and lie along the body axis, and a lock-open notch therein in facing relation to the inward curl of the locking plate when the implement is rotated on the axle to extend outwardly from the body and lie along the body axis; and a locking lever comprising a locking lever top having a lock actuator plate extending therefrom, the lock actuator plate being in facing relationship to the locking plate, two opposing locking lever sides affixed to the locking lever top, the locking lever being open on a fourth side, the two locking lever sides being spaced sufficiently far apart that they lie outwardly of the two body sides, and a pair of aligned axle engagement bores extending through the two locking lever sides, the axle engagement bores being engaged to the axle such that the locking lever is engaged to and rotatable on the axle, the locking lever being rotatable between an unlocked position wherein the inward curl of the lock actuator plate does not engage the locking plate, and a locked position wherein the inward curl of the lock actuator plate engages the locking plate to force it into contact with the base of each implement.

2. The tool of claim 1, further including a handle comprising a handle top, and two opposing handle sides affixed to the handle top, the handle sides being dimensioned such that the body is received therebetween with the locking lever sides lying outwardly of the two handle sides.

3. The tool of claim 1, further including a multipurpose tool having a handle comprising a handle top, and two opposing handle sides affixed to the handle top, the handle sides being dimensioned such that the body is received therebetween with the locking lever sides lying outwardly of the two handle sides.

4. The tool of claim 1, wherein the at least one implement comprises at least four implements.

5. A tool, comprising:

an elongated body having a U-shaped housing with a body top and two opposing body sides;

a locking plate extending from the body top;

two opposing body sides affixed to the body top;

an axle extending between and through the two opposing body sides;

at least one implement having a base, each implement being disposed between the two body sides and rotatably supported on the axle, each base having a lock-close notch therein in facing relation to the locking plate when the implement is rotated on the axle to lie between the two sides and lie along the body axis, and a lock-open notch therein in facing relation to the locking plate when the implement is rotated on the axle to extend outwardly from the body and lie along the body axis; and a U-shaped locking lever with a locking lever top and two locking lever sides spaced sufficiently far apart that they lie outwardly of the two body sides, the locking lever being engaged to and rotatable on the axle; and a lock actuator plate extending from the locking lever top, the lock actuator plate being in facing relationship to the locking plate, the locking lever being rotatable between an unlocked position wherein the lock actuator plate does not engage the locking plate, and a locked position wherein the lock actuator plate engages the locking plate to force it into contact with the base of each implement.

6. The tool of claim 5, further including a handle comprising a handle top, and two opposing handle sides affixed to the handle top, the handle sides being dimensioned such that the body is received therebetween with the locking lever sides lying outwardly of the two handle sides.

7. The tool of claim 5, further including a multipurpose tool having a handle comprising a handle top, and two opposing handle sides affixed to the handle top, the handle sides being dimensioned such that the body is received therebetween with the locking lever sides lying outwardly of the two handle sides.

8. The tool of claim 5, wherein the at least one implement comprises at least four implements.

9. A tool, comprising:

an elongated body;

at least two implements, each implement being pivotably connected to the body and rotatable between a closed position wherein the implement lies within the body and an open position wherein the implement extends from the body;

a single lock operable to lock the implements into either the open position or the closed position, the single lock including a locking lever pivotably connected to the elongated body, wherein the implements and the locking lever are pivotable on the same axle.

10. The tool of claim 9, wherein the lock includes a locking bar, and wherein operation of the locking lever controllably forces the locking bar into contact with a base portion of each implement.

11. A tool, comprising:

an elongated body;

at least two implements, each implement being pivotably connected to the body and rotatable between a closed position wherein the implement lies within the body and an open position wherein the implement extends from the body;

a single lock operable to lock the implements into either the open position or the closed position, the single lock including a locking lever pivotably connected to the elongated body, wherein each implement has a base with a lock-open notch and a lock-close notch, wherein the lock includes a locking plate disposed in facing contact with the lock-open notch when the implement is rotated to the open position, and disposed in facing contact with the lock-close notch when the implement is rotated to the closed position, and wherein the locking lever is operable to force the locking plate toward the base of the implement.

12. A tool, comprising:

an elongated body;

at least two implements, each implement being pivotably connected to the body and rotatable between a closed position wherein the implement lies within the body and an open position wherein the implement extends from the body;

a single lock operable to lock the implements into either the open position or the closed position, the single lock including a locking lever pivotably connected to the elongated body; and a handle dimensioned to slidably receive the elongated body therein.

13. A tool, comprising:

an elongated body;

at least two implements, each implement being pivotably connected to the body and rotatable between a closed position wherein the implement lies within the body and an open position wherein the implement extends from the body;

a single lock operable to lock the implements into either the open position or the closed position, the single lock including a locking lever pivotably connected to the elongated body; and a handle, and wherein the elongated body is slidably received within the handle and locked thereto.

* * * * *